US008425209B2

(12) United States Patent
Larsson

(10) Patent No.: US 8,425,209 B2
(45) Date of Patent: Apr. 23, 2013

(54) VAPOR RECOVERY PUMP

(75) Inventor: Bengt I. Larsson, Skivarp (SE)

(73) Assignee: Dresser, Inc., Addison, TX (US)

( * ) Notice: Subject to any disclaimer, the term of this patent is extended or adjusted under 35 U.S.C. 154(b) by 834 days.

(21) Appl. No.: 11/557,339

(22) Filed: Nov. 7, 2006

(65) Prior Publication Data

US 2007/0154332 A1 Jul. 5, 2007

(30) Foreign Application Priority Data

Nov. 7, 2005 (EP) ..... 05110415

(51) Int. Cl.
*F04B 35/04* (2006.01)
*F04B 17/04* (2006.01)

(52) U.S. Cl.
USPC ..... 417/418

(58) Field of Classification Search ..... 417/404, 417/418, 416, 420, 43, 415, 494, 499, 502, 417/503; 310/15; 318/119
See application file for complete search history.

(56) References Cited

U.S. PATENT DOCUMENTS

| | | | | |
|---|---|---|---|---|
| 2,067,819 | A * | 1/1937 | Joseph Bell | 417/418 |
| 2,701,331 | A * | 2/1955 | Holst | 318/128 |
| 3,791,770 | A * | 2/1974 | Farkos | 417/418 |
| 3,791,771 | A * | 2/1974 | Roesel, Jr. | 417/418 |
| 3,826,291 | A | 7/1974 | Steffens | 141/59 |
| 3,847,507 | A | 11/1974 | Sakiyama et al. | 417/22 |
| 3,884,125 | A * | 5/1975 | Massie | 92/13.5 |
| 4,223,706 | A | 9/1980 | McGahey | 141/59 |
| 4,272,226 | A * | 6/1981 | Osborne | 417/418 |
| 4,276,003 | A * | 6/1981 | Perkins et al. | 417/415 |
| 4,282,738 | A * | 8/1981 | Kojima et al. | 72/389.3 |
| 4,455,127 | A * | 6/1984 | Tabuchi et al. | 417/418 |
| 4,541,787 | A * | 9/1985 | DeLong | 417/417 |
| 4,547,134 | A * | 10/1985 | Hirvonen | 417/349 |
| 4,750,871 | A | 6/1988 | Curwen | 417/418 |
| 5,106,268 | A | 4/1992 | Kawamura et al. | 417/45 |
| 5,123,817 | A | 6/1992 | Willemsen | 417/404 |
| 5,462,078 | A * | 10/1995 | Andenmatten et al. | 137/209 |
| 5,490,387 | A * | 2/1996 | Bisson et al. | 60/734 |
| 5,494,409 | A * | 2/1996 | Webb et al. | 417/53 |
| 5,651,389 | A * | 7/1997 | Anderson | 137/565.11 |
| 5,785,501 | A * | 7/1998 | Van Coillie et al. | 417/69 |
| 6,354,818 | B2 * | 3/2002 | Morita et al. | 417/419 |
| 2004/0219041 | A1 * | 11/2004 | Rijnberg | 417/416 |
| 2005/0141998 | A1 * | 6/2005 | Yoo et al. | 417/44.1 |
| 2006/0127252 | A1 * | 6/2006 | Caddell | 417/418 |

FOREIGN PATENT DOCUMENTS

| | | |
|---|---|---|
| EP | 0106414 A2 | 4/1984 |
| EP | 0380777 A1 | 8/1990 |

* cited by examiner

*Primary Examiner* — Devon Kramer
*Assistant Examiner* — Amene Bayou
(74) *Attorney, Agent, or Firm* — Hiscock & Barclay LLP

(57) ABSTRACT

A vapor recovery pump for a fuel dispensing unit, comprising a housing with two chambers each having a vapor inlet valve and a vapor outlet valve, respectively, the chambers being separated by a movable piston arranged to move a distance between a first and a second end position inside the housing for continuously decreasing and increasing the volume of the chambers. A control element is arranged to selectively vary the location of the first end position.

19 Claims, 3 Drawing Sheets

VAPOR RECOVERY PUMP

CLAIM OF PRIORITY

This application claims priority under European Patent Application No. 05110415.6, filed on Nov. 7, 2005, the entire contents of which are hereby incorporated by reference.

TECHNICAL FIELD

The present invention relates to a vapor recovery pump for a fuel dispensing unit, said pump comprising a housing with two chambers each having a vapor inlet valve and a vapor outlet valve, respectively, the chambers being separated by a movable piston arranged to move a distance between a first and a second end position inside the housing for continuously decreasing and increasing the volume of the chambers.

BACKGROUND

When filling the fuel tank of a motor vehicle, it is a common measure to recover the vapor escaping the tank when filling it with liquid fuel. This measure is taken for both safety and environmental reasons. The vapor recovery is achieved, for instance, by arranging a vapor suction nozzle next to the fuel dispensing nozzle of a pistol grip for filling the tank with fuel. Vapor is then removed from the tank during filling, at a certain rate, which is often controlled by the standard rate at which fuel is dispensed to the tank. Vapor recovery systems typically comprise a pump for feeding vapor, from the tank of the vehicle, to the fuel container from which fuel is fed to the vehicle. This mutual exchange of vapor/fuel is continuously performed when filling a vehicle with fuel.

PRIOR ART

Problems

Several pumps for feeding vapor are known in the art. A general problem with existing vapor pumps is that they take up a lot of space and are relatively complex in their arrangement, which causes increased costs both in respect of production and maintenance.

U.S. Pat. No. 3,826,291

U.S. Pat. No. 3,826,291, for example, discloses a filling system for vehicle fuel, which system comprises means for recovering fuel vapor. The system comprises a fuel pump and a fuel meter with an output shaft which is connected to a fuel vapor pump which draws in vapor from the tank of the vehicle. The connection is carried out by means of gear wheels in such manner that the volume of dispensed fuel corresponds to the volume of drawn-in vapor. Crank driven piston pumps are used, for example, and the motion of the piston is used on one side only, i.e. the piston is single-acting. A problem with the device described above is that a complex and expensive seal between the piston and the piston shaft is required in order to prevent vapor and any entrained fuel droplets from entering the crank side of the piston. Furthermore, the gear wheel connection is complex and expensive.

U.S. Pat. No. 5,123,817

U.S. Pat. No. 5,123,817 discloses a filling system where a double-acting piston pump is used as vapor pump. A common shaft is connected between the piston pump and a fuel pump. This permits a coordinated direct operation of the fuel pump and the vapor pump, but again the connection is complex.

U.S. Pat. No. 4,223,706

U.S. Pat. No. 4,223,706 discloses a similar construction of a filling system where a flow of fuel through a hydraulic motor initiates the return flow of vapor through a vapor pump. In this construction, a direct operation, i.e. a common drive shaft, is available between the hydraulic motor and the vapor pump. An overflow valve is arranged between the inlet opening of the vapor pump and the fuel container of the filling system, to equalize pressure changes in the system.

In summary, a problem associated with prior art is high production costs due to complex arrangements. Maintenance is also cumbersome and many of the techniques are sensitive to vapor and fuel occurrence on the wrong side of a piston. Another problem is that the arrangements are rather voluminous and require a lot of space when mounted inside a fuel dispensing unit.

SUMMARY

It is an object of the present disclosure to provide an improvement to the above techniques and prior art. A particular object is to provide a vapor recovery pump and a fuel dispensing unit of improved construction offering lower production costs and a reduced need for maintenance. Another object is to provide a vapor recovery pump having a smaller size and thereby requiring less mounting space. These and other objects and advantages that will be apparent from the following description are achieved by a vapor recovery pump and a dispensing unit according to the claims. Specific implementations are defined in the dependent claims.

For example, a vapor recovery pump for a fuel dispensing unit comprises a housing with two chambers each having a vapor inlet valve and a vapor outlet valve, respectively, the chambers being separated by a movable piston arranged to move a distance between a first and a second end position inside the housing for continuously decreasing and increasing the volume of the chambers. A control element is arranged to selectively vary the location of the first end position. This may be an efficient and reliable way of recalibrating the pump and/or changing its vapor pumping capacity. Yet another advantage is that the pump according to some implementations is insensitive to vapor occurring on both sides of the piston.

Another advantage with a pump according to some implementations is that it may be possible to select the location of the first end position so that vapor flows through one of the chambers while no or basically no vapor flows through the other chamber, when the piston is continuously moved from the location of the first end position to the location of the second end position and back again. In other words, the piston may oscillate between the first and second end positions.

Still another advantage is that it may be possible to select the location of the first end position so that vapor flows through both of the chambers. Hence the selection of the location of the first end position may make it possible to select whether the pump operates with double or single action. The principle behind this feature is based on setting the first end position at a location where one of the chambers has a significantly larger operating volume than the other chamber. In the larger chamber, when the piston oscillates between the two end positions, a relatively small change of operating volume may cause a small change of pressure within the chamber. This small change of pressure may be insufficient for making vapor enter and exit the large chamber through its inlet and outlet valves, and vapor may be only compressed and expanded inside the large chamber. In the smaller chamber, on the other hand, when the piston oscillates between the two end positions, a relative greater change of operating volume may cause a greater change of pressure within the chamber. This greater change of pressure may cause vapor to enter and exit the small chamber through its inlet and outlet valves, and vapor may be pumped through the smaller chamber.

The control element may be arranged to also selectively vary the location of the second end position. This feature may allow more efficient control of the operating volume of the chambers, including the relative change of volumes when the piston moves between the end positions. Another advantage is that it may be possible to vary which chamber shall feed vapor and which chamber shall remain inactive, by varying the location of the two end positions. Of course, by changing at least one of the end position locations, the distance between the end positions may also be selectively variable.

The outlet valve of a chamber may be arranged to open only when the pressure within the chamber exceeds a specific level, and the inlet valve of a chamber may be arranged to open only when the pressure within the chamber falls below a specific level. This makes it possible to more efficiently vary the flow of vapor pumped through the chambers since the valves are less sensitive to chamber volume changes.

The control element may further be specifically arranged to set the location of the two end positions, and to move the piston between the two end positions to continuously increase and decrease the pressure within the chambers, so that the valves in one chamber may be continuously opened and closed, respectively, while the valves in the other chamber remain closed. This specific arrangement may offer all the advantages described above and according to a variant, the control element may be arranged to selectively set the location of the two end positions, for the purpose of selecting which one of the chambers is to have its valves continuously opened and closed, respectively, or, in other words, selecting through which chamber vapor shall flow.

According to a first variant, the control element comprises a magnetic control element for moving the piston between the two end positions. In this variant, the piston may be magnetic and the magnetic control element may comprise coils arranged around the housing and a control unit arranged to selectively feed the coils with an electric current for moving the piston between the two end positions by magnetic attraction between the piston and the coils. According to a second variant, the control element comprises a rotatable screw-threaded axle passing through a screw-threaded hole in the piston, and a control unit arranged to selectively vary the rotation of the axle for moving the piston between the two end positions. The two variants above both have the advantage of a compact design suitable for varying the location of at least one end position of the piston.

The control element may further comprise an intelligent device having a software application for selectively varying the location of the end positions. This may be advantageous for efficient and fast control of selective locations of the end positions of a piston. The control element may further comprise data tables or curves where vapor flow through the chambers is a function of the first, second and/or both end positions. The control element may also comprise element for varying the flow of fluid through the chambers based on varying the piston oscillation amplitude, which depends on the end positions of the piston.

The vapor recovery pump may further comprise a vapor flow return line for recirculation of vapor, wherein the vapor flow return line comprises a vapor flow control valve. The vapor flow return line may provide improved control of vapor flow by recirculating the vapor through the vapor recovery pump, and the control valve is typically regulated by the control element. The vapor flow return line may be connected at least to one inlet valve and outlet valve of one chamber, and/or the vapor flow return line may be connected at least to one outlet valve of one chamber and to one inlet valve of the other chamber. This may provide an efficient arrangement for recirculation of vapor, but of course the flow return line may be arranged along any suitable vapor line connected to the inlet and outlet valves of the vapor recovery pump.

According to another aspect of the disclosure, a fuel dispensing unit may be provided, comprising a vapor recovery pump, wherein at least one vapor suction nozzle is connected, via a vapor flow line, to an inlet valve of the vapor recovery pump. In one implementation, the fuel dispensing unit may have a first vapor suction nozzle connected, via a first vapor flow line, to the inlet valve of the first chamber of the pump, and a second vapor suction nozzle may be connected, via a second vapor flow line, to the inlet valve of the second chamber of the pump.

In another implementation, the fuel dispensing unit may have at least one vapor suction nozzle connected, via a manifold, to the inlet valve of the first chamber of the pump and the inlet valve of the second chamber of the pump. Furthermore, at least one vapor flow line of the fuel dispensing unit may incorporate a control valve. The fuel dispensing unit of the disclosure may provide flexible implementation and installation of the vapor recovery pump, as well as incorporate one or more of the above described advantages of the vapor recovery pump.

In an exemplary embodiment, a vapor recovery pump for a fuel dispensing unit may comprise a housing having a first end wall and a second end wall and a movable piston arranged to move inside the housing alternately towards a selectively variable first end position and a selectively variable second end position, the movable piston and the first end wall may define a first chamber having a first variable volume and the movable piston and the second end wall may define a second chamber having a second variable volume. A first vapor inlet valve and a first vapor outlet valve may be connected to the first chamber, wherein the first vapor inlet valve and the first vapor outlet valve may open and close in response to pressure of the vapor in the first chamber. A second vapor inlet valve and a second vapor outlet valve may be connected to the second chamber, the second vapor inlet valve and the second vapor outlet valve may open and close in response to pressure of the vapor in the second chamber. There may also comprise a first vapor flow line coupled to the first vapor inlet valve, a second vapor flow line coupled to the second vapor inlet valve, a first vapor flow measuring device disposed on the first vapor flow line to measure a first vapor flow, and a second vapor flow measuring device disposed on the second vapor flow line to measure a second vapor flow. The control element may be configured to set a location of the selectively variable first end position of the movable piston relative to the first end wall of the housing, and regulate the movable piston based on the first vapor flow and the second vapor flow, such that the pressure of the vapor in the first chamber is not changed sufficiently to open the first vapor inlet valve and the first vapor outlet. A fuel dispensing unit may comprise one or more of the aforementioned vapor recovery pumps.

The details of one or more implementations of the invention are set forth in the accompanying drawings and the description below. Other features, objects, and advantages of the invention will be apparent from the description and drawings, and from the claims.

DETAILED DESCRIPTION

Figure 1:
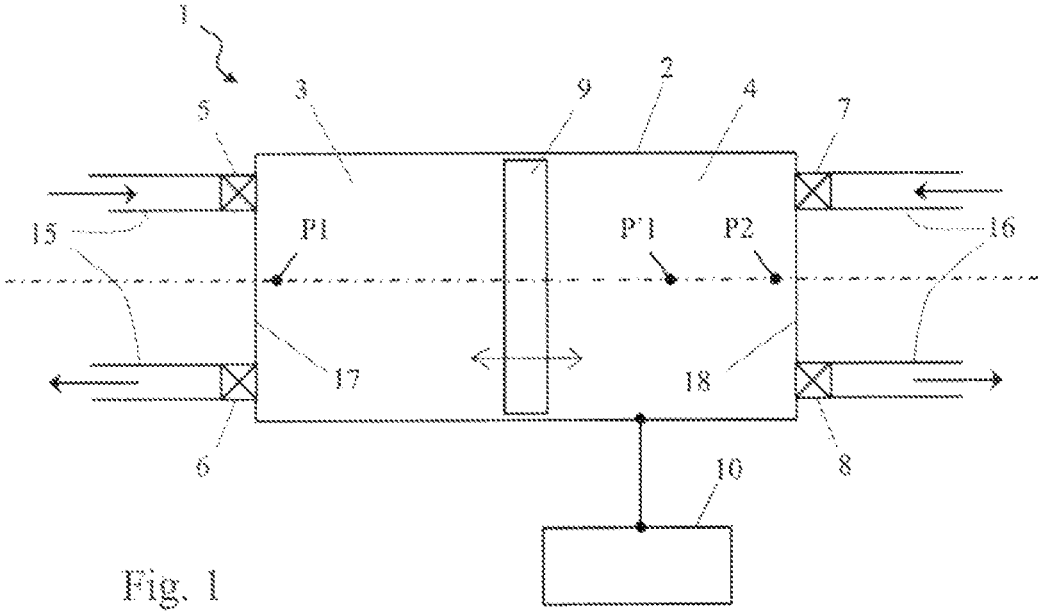
FIG. 1 is a schematic drawing of an example vapor recovery pump.

FIG. 1 shows a vapor recovery pump 1 having a housing 2 that is separated into a first chamber 3 and a second chamber 4. The first chamber 3 has an inlet valve 5, an outlet valve 6 and a chamber end wall 17, while the second chamber 4 also has an inlet valve 7, an outlet valve 8 and a chamber end wall 18. The chambers 3, 4 are separated by a piston 9 arranged inside the housing 2 and substantially seals the chambers 3, 4 to prevent fluid communication there between. Control element 10 is arranged to move the piston 9 along a geometrical axis A between a first outermost end position P1 and a second outermost end position P2 located on the axis A. A first vapor recovery line 15 is connected to the first chamber valves 5-6, and a second vapor recovery line 16 is connected to the second chamber valves 7, 8. Each line 15, 16 generally has an associated upstream vapor suction nozzle and an associated downstream fuel container, from which fuel is fed to the vehicle. This configuration may allow different types of vapor to be recovered by the same fuel dispensing unit incorporating the vapor pump according to the disclosure, without mixing the different vapor types. The control element 10 is also arranged to move the piston between its outermost end positions P1, P2, and to allow selective variation if the location of the end positions P1, P2. A second location P'1 of the first end position P1 is shown in FIG. 1, wherein P'1 is located a greater distance from the first chamber end wall 17 compared with the distance from P1 to the first chamber end wall 17.

Operation

When the piston 9 is continuously moved between its outermost end positions P1 and P2, the relative change of volume of the chambers 3, 4, and hence change of pressure within the chambers 3, 4, may cause the valves 5-8 to open and close in a manner known in the art for feeding vapor from the tank of a vehicle, through the chambers 3, 4, to a petrol station fuel container. This operation often corresponds to operation of a double-action pump. For this operation it should be noted that the operating volume of the first chamber 3 substantially corresponds to the operating volume of the second chamber 4.

In order to feed vapor through only, for example, the second chamber 4, the piston 9 may oscillate between P'1 and P2. Since P'1 is at a greater distance from the first chamber end wall 17 than P1 and the piston area is constant, the relative change of volume of the first chamber 3 may be much smaller and, hence, its relative change of pressure may be much smaller. Since the change of pressure is not increased or decreased sufficiently for opening the outlet valve 6 or inlet valve 5, no vapor may be fed through the chamber 3. Typically the volume of the first chamber 3 should be decreased by at least 50%, when the piston 9 is operated and moves from P2 to P'1, before the pressure within the chamber 3 causes the valve 6 to open. A corresponding increase of volume applies for the opening of the inlet valve 5, and a corresponding situation may apply for the second chamber 4 and its valves 7, 8.

The specific pressure levels at which the valves 5-8 open as well as the location of the end positions P1, P2 are often based on experimental data, and data indicating specific end position locations may give a specific flow of vapor through the chambers, stored in the control element 10. The control element 10 may further vary the piston oscillation speed to obtain a specific pump capacity according to oscillations/speed data also stored in the means 10.

Magnetic

Figure 2:
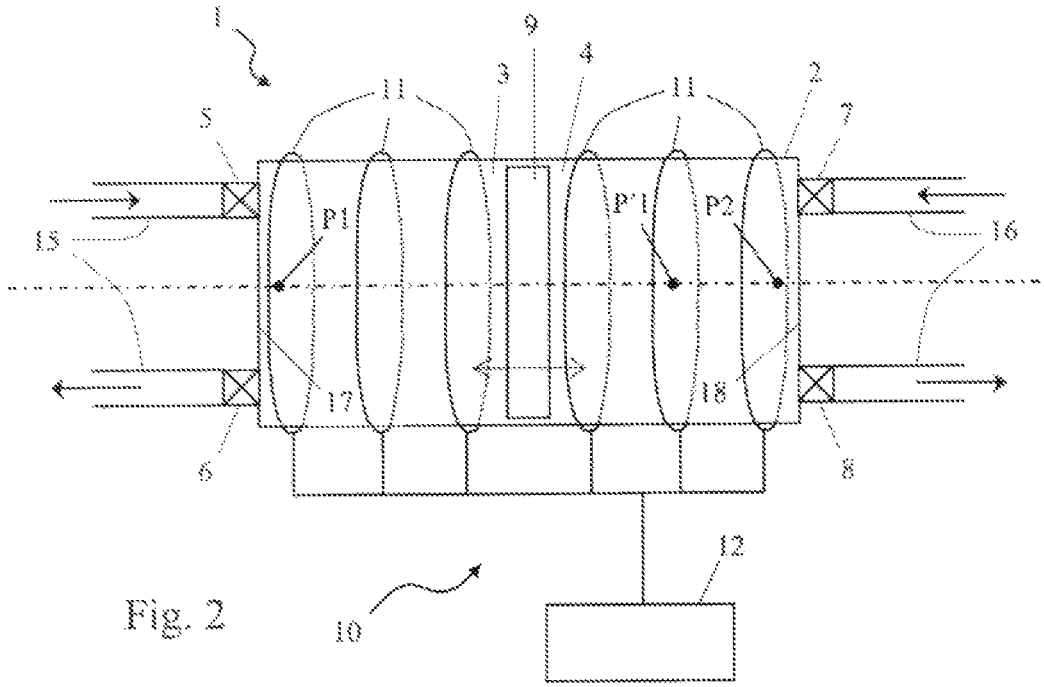
FIG. 2 is a schematic drawing of an example vapor recovery pump comprising magnetic control element.

As illustrated in FIG. 2 and according to a variant of the disclosure, coils 11 may be arranged around the housing 2, which coils 11 preferably are made of copper. The piston 9 may be magnetic and the control element 10 may comprise a control unit 12 for sending electric current through the coils 11 and thereby creating magnetic attraction between the piston 9 and the coils 11. When a current flows, for example, only in a coil arranged at the first chamber wall end 17, the piston may be attracted to that coil and move towards the first wall end 17. By having several coils 11 arranged around the housing 2 and by controlling the current flowing through them, the piston 9 may oscillate between the various locations to achieve the effects described above. A magnetic attraction and retraction effect may be utilized by controlling the direction of the currents flowing in the coils 11.

Axle

Figure 3:
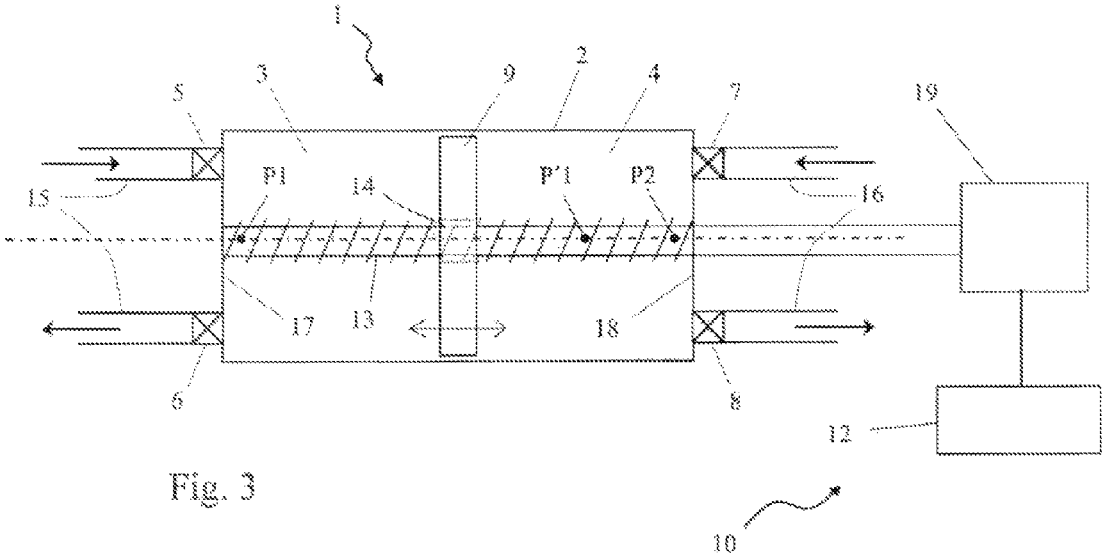
FIG. 3 is a schematic drawing of an example vapor recovery pump comprising a rotatable screw-threaded axle.

As illustrated in FIG. 3 and according to another variant of the disclosure, a screw-threaded axle 13 sealingly enters the housing 2 and fits through a matching screw-threaded hole 14 in the piston 9. The axle 13 is parallel with the direction of movement of the piston 9 and is rotated by an electric motor 19. The motor 19 may be controlled by a control unit 12 that variably changes the rotational direction of the axle 13 so that the piston 9 may oscillated between the two end positions P1, P2. A specific number of axle revolutions in a specific direction may correspond to a specific piston location, or the location of the end positions P1, P2, and by controlling the axle revolutions the piston 9 may oscillate between the various locations to achieve the effects previously described. The relationship between axle revolutions and piston locations is stored as data in the control unit 12.

Fuel Dispensing Unit

Figure 4:
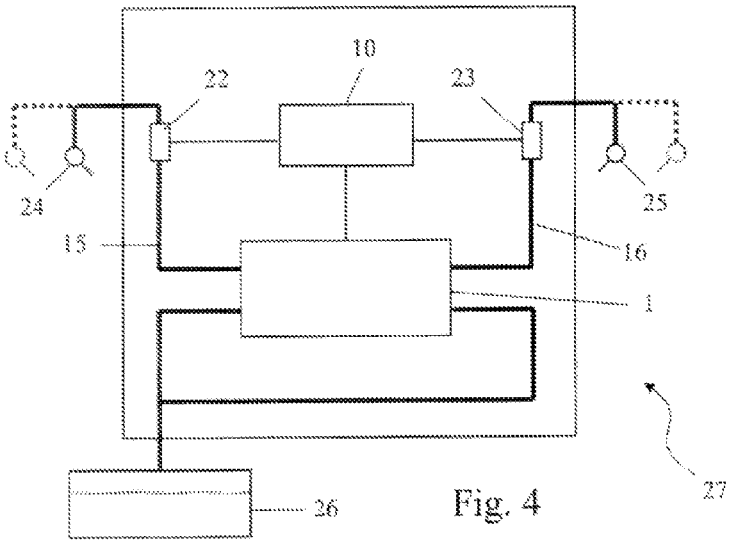
FIG. 4 is a schematic drawing of an example fuel dispensing unit incorporating a vapor recovery pump.

FIG. 4 illustrates a fuel dispensing unit 27 incorporating the vapor recovery pump 1. A vapor suction nozzle 24 may be arranged next to a fuel nozzle in a pistol grip for dispensing fuel (not shown), and may be, via the first vapor flow line 15, connected to the inlet valve 5 of the first chamber 3 of the vapor recovery pump 1. Correspondingly, a second vapor suction nozzle 25 may be, via the second flow line 16, connected to the inlet valve 7 of the second chamber 4. Both vapor flow lines 15, 16 exits the corresponding outlet valve and may be connected to a fuel tank 26, where the vapor enters. The control element 10 may be connected to the vapor pump 1 for controlling the flow of vapor by controlling the oscillation of the piston 9 in respect of amplitude, frequency and end positions P1, P2, as earlier described.

Preferably, the vapor flow lines 15, 16 comprise vapor flow measuring devices 22, 23 connected to the control element 10. Based on the measured vapor flow and/or the amount and rate of fuel dispensed from the fuel dispensing unit, the control element 10 may regulate the oscillation of the vapor recovery pump 1.

Figure 5:
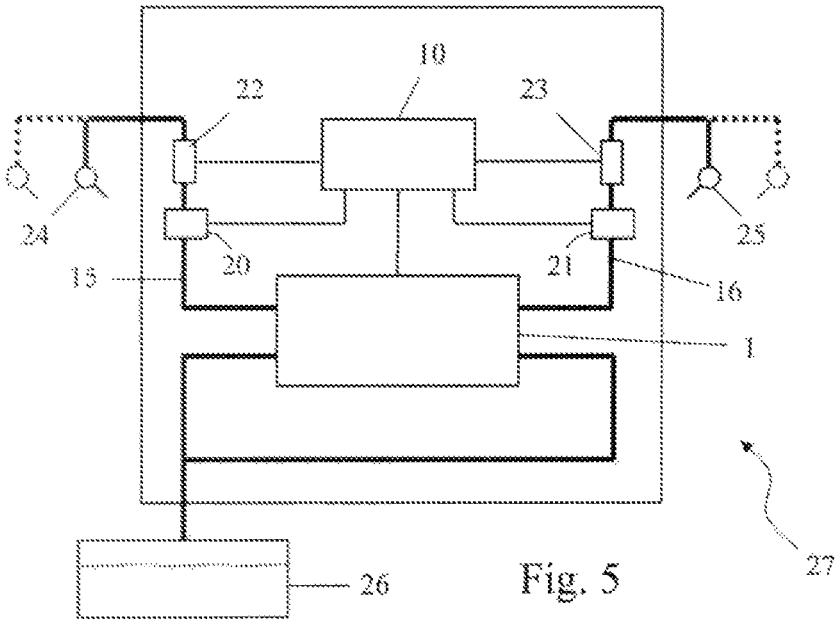
FIG. 5 is a schematic drawing of the fuel dispensing unit of FIG. 4, further incorporating control valves.

Turning now to FIG. 5, the vapor flow lines 15, 16 in a variant may also comprise a control valve 20, 21 each. These control valves 20, 21 may be connected to the control element 10 for additional control of the flow of vapor. That is, when an increased vapor flow is desired in a vapor line 15, 16, the control element 10 may open corresponding control valve 20, 21 to a desired level, and when the flow should be decreased, the valve opening (not shown) in the control valve 20, 21 may be made correspondingly smaller.

Figure 6:
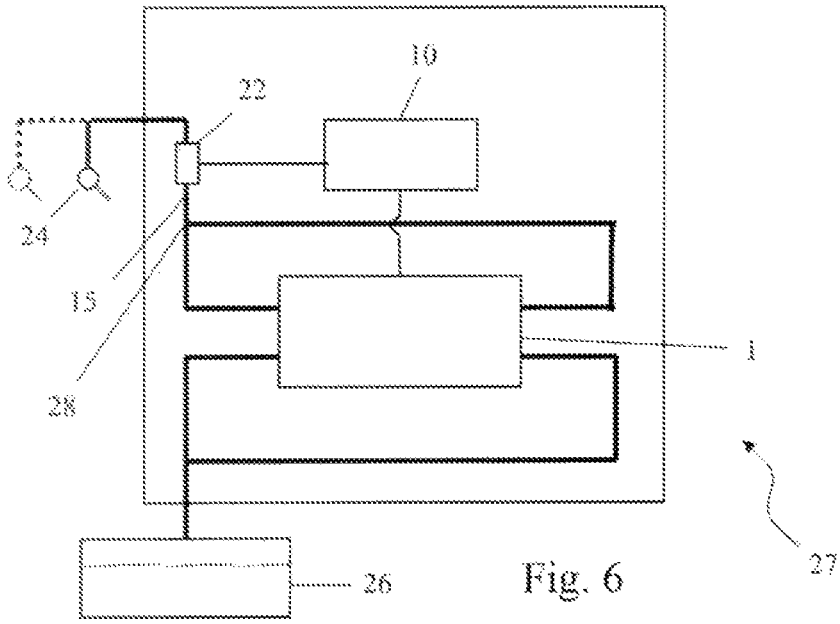
FIG. 6 is a schematic drawing of an example fuel dispensing unit having a single vapor flow line.

FIG. 6 illustrates a variant of a fuel dispensing unit 27 incorporating the vapor recovery pump 1. A vapor suction nozzle 24 may be arranged next to a fuel nozzle in a pistol grip for dispensing fuel (not shown), and may be, via a manifold 28, connected to both the inlet valve 5 of the first chamber 3 and the inlet valve 7 of the second chamber 4 of the vapor recovery pump 1. As described above, control element 10 may be connected to the vapor pump 1 for controlling the flow of vapor by controlling the oscillation of the piston 9 in respect of amplitude, frequency and end positions. A vapor flow measuring device 22 is preferably, on the upstream side of the manifold 28, incorporated in the vapor flow line 15 and, of course, a control valve (not shown) may be incorporated as well. Control of flow of vapor is in this variant performed in the same manner as earlier described. For the fuel dispensing unit according to the disclosure, it is also possible to arrange several parallel vapor suctions nozzles in the same fuel line.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A vapor recovery pump for a fuel dispensing unit, the vapor recovery pump comprising:

a housing having a first end wall and a second end wall;

a movable piston arranged to move inside the housing alternately towards a selectively variable first end position and a selectively variable second end position, the movable piston and the first end wall defining a first chamber having a first variable volume and the movable piston and the second end wall defining a second chamber having a second variable volume;

a first vapor inlet valve and a first vapor outlet valve connected to the first chamber, the first vapor inlet valve and the first vapor outlet valve opening and closing in response to pressure of the vapor in the first chamber;

a second vapor inlet valve and a second vapor outlet valve connected to the second chamber, the second vapor inlet valve and the second vapor outlet valve opening and closing in response to pressure of the vapor in the second chamber;

a first vapor flow line coupled to the first vapor inlet valve;

a second vapor flow line coupled to the second vapor inlet valve;

a first vapor flow measuring device disposed on the first vapor flow line to measure a first vapor flow;

a second vapor flow measuring device disposed on the second vapor flow line to measure a second vapor flow; and a control element configured to set a location of the selectively variable first end position of the movable piston relative to the first end wall of the housing, and regulate the movable piston based on the first vapor flow and the second vapor flow, such that the pressure of the vapor in the first chamber is not changed sufficiently to open the first vapor inlet valve and the first vapor outlet valve.

2. A vapor recovery pump according to claim 1, wherein the control element is arranged to selectively vary the location of the selectively variable second end position relative to the second end wall of the housing.

3. A vapor recovery pump according to claim 1, wherein the control element is arranged to oscillate the movable piston between the selectively variable first end position and the selectively variable second end position.

4. A vapor recovery pump according to claim 1, wherein the first vapor outlet valve of the first chamber is arranged to open in response to the pressure within the first chamber exceeding a specific level.

5. A vapor recovery pump according to claim 1, wherein the first vapor inlet valve is arranged to open in response to the pressure within the first chamber falling below a specific level.

6. A vapor recovery pump according to claim 1, wherein the control element is arranged to set the location of the selectively variable first end position and selectively variable second end position, and to move the movable piston between the set location of the selectively variable first end position and set location of the selectively variable second end position to continuously increase and decrease the pressure within the first chamber and the second chamber, so that the second vapor inlet valve and the second vapor outlet valve are continuously opened and closed, respectively, while the first vapor inlet valve and the second vapor inlet valve remain closed.

7. A vapor recovery pump according to claim 1, wherein the control element comprises a magnetic control element for moving the movable piston between the selectively variable first end position and the selectively variable second end position.

8. A vapor recovery pump according to claim 7, wherein the movable piston is magnetic and the magnetic control element comprise coils arranged around the housing, and a control unit arranged to selectively feed the coils with an electric current for moving the movable piston between the selectively variable first end position and the selectively variable second end position.

9. A vapor recovery pump according to claim 1, wherein the control element comprise a rotatable screw-threaded axle passing through a screw-threaded hole in the movable piston, and a control unit arranged to selectively vary the rotation of the rotatable screw-threaded axle for moving the movable piston between the selectively variable first end position and the selectively variable second end position.

10. A vapor recovery pump according to claim 1, wherein the control element comprise an intelligent device having a software application for selectively varying the location of the selectively variable first end position and the selectively variable second end position.

11. A vapor recovery pump according to claim 1, further comprising a vapor flow return line for recirculation of vapor, said vapor flow return line comprising a vapor flow control valve.

12. A vapor recovery pump according to claim 11, wherein the vapor flow return line is connected at least to the first vapor inlet valve and the second vapor outlet valve.

13. A fuel dispensing unit comprising:

a vapor recovery pump comprising:

a housing having a first end wall and a second end wall;

a movable piston arranged to move inside the housing alternately towards a first end position and a second end position, the movable piston and the first end wall defining a first chamber having a first variable volume and the second end wall and the movable piston defining a second chamber having a second variable volume;

a first vapor inlet valve and a first vapor outlet valve connected to the first chamber, the first vapor inlet valve and the first vapor outlet valve opening and closing in response to pressure of the vapor in the first chamber;

a second vapor inlet valve and a second vapor outlet valve connected to the second chamber, the second vapor inlet valve and the second vapor outlet valve opening and closing in response to pressure of the vapor in the second chamber;

a first vapor flow line coupled to the first vapor inlet valve;

a second vapor flow line coupled to the second vapor inlet valve;

a first vapor flow measuring device disposed on the first vapor flow line to measure a first vapor flow;

a second vapor flow measuring device disposed on the second vapor flow line to measure a second vapor flow; and a control element configured to set a location of the first end position of the movable piston relative to the first end wall of the housing, and regulate the movable piston based on the first vapor flow and the second vapor flow, such that the pressure of the vapor in the first chamber is not changed sufficiently to open the first vapor inlet valve and the first vapor outlet valve.

14. A fuel dispensing unit according to claim 13, wherein a first vapor suction nozzle is connected, via a first vapor flow line, to the first vapor inlet valve of the vapor recovery pump, and a second vapor suction nozzle is connected, via a second vapor flow line, to the second vapor inlet valve.

15. A fuel dispensing unit according to claim 14, wherein at least one of the first and second vapor flow lines comprises a control valve.

16. A fuel dispensing unit according to claim 13, wherein the at least one vapor suction nozzle is connected, via a manifold, to the first vapor inlet valve and the second vapor inlet valve.

17. A fuel dispensing unit according to claim 13, wherein the control element is arranged to selectively vary the location of the second end position relative to the second end wall of the housing.

18. A fuel dispensing unit according to claim 13, wherein the control element is arranged to oscillate the movable piston between the first and second end positions.

19. A fuel dispensing unit according to claim 13, wherein the control element is arranged to set the location of the first end position and the second end position, and to move the movable piston between the first end position and the second end position based on the first vapor flow and second vapor flow to continuously increase and decrease the pressure within the first and second chamber, so that the second vapor inlet valve and the second vapor outlet valve are continuously opened and closed, respectively, while the first vapor outlet valve and the first vapor inlet valve remain closed.

* * * * *